US005423496A

United States Patent [19]

Röder

[11] Patent Number: 5,423,496

[45] Date of Patent: Jun. 13, 1995

[54] DEVICE FOR CONNECTING PAPER WEBS

[75] Inventor: Klaus W. Röder, Würzburg, Germany

[73] Assignee: Koenig & Bauer Aktiengesellschaft, Wurzburg, Germany

[21] Appl. No.: 72,953

[22] Filed: Jun. 8, 1993

[30] Foreign Application Priority Data

Jun. 9, 1992 [DE] Germany ..... 42 18 825.3

[51] Int. Cl.[6] ..... B65H 19/18

[52] U.S. Cl. ..... 242/555.5

[58] Field of Search ..... 242/58, 58.1, 58.2, 242/58.3, 58.4, 551, 555, 555.3, 555.5; 156/157, 502, 504, 505, 506, 507

[56] References Cited

U.S. PATENT DOCUMENTS

| | | | |
|---|---|---|---|
| 1,967,056 | 1/1932 | Horton . | |
| 2,217,897 | 12/1936 | Freeman . | |
| 4,564,149 | 1/1986 | Barzano' | 242/58.1 |
| 4,905,924 | 3/1990 | Moore . | |
| 4,936,942 | 6/1990 | Sollinger et al. | 156/504 |
| 5,133,511 | 7/1992 | Mack et al. | 242/57.1 |

FOREIGN PATENT DOCUMENTS

| | | | |
|---|---|---|---|
| 0049376 | 9/1981 | European Pat. Off. . | |
| 0393519 | 10/1990 | European Pat. Off. | 242/54 R |
| 86409 | 12/1971 | German Dem. Rep. . | |
| 878945 | 6/1953 | Germany . | |
| 1-267243 | 10/1989 | Japan | 242/58.1 |
| 1334704 | 10/1973 | United Kingdom | 242/58.1 |
| 1359476 | 7/1974 | United Kingdom . | |

OTHER PUBLICATIONS

Patent Abstract of Japan; Publication No. JP63212655; Publication Date: Sep. 5, 1988.

Patent Abstract of Japan; Publication No. JP4173646; Publication Date Jun. 22, 1992.

*Primary Examiner*—Daniel P. Stodola
*Assistant Examiner*—John P. Darling
*Attorney, Agent, or Firm*—Jones, Tullar & Cooper

[57] ABSTRACT

A device for connecting paper webs in a web-fed rotary printing press utilizes a pivotable support frame to move a paper web tension compensation device into a position against the paper web prior to a flying web splice. An upper roller on the compensation device applies pressure to the depleting web to adhere it to the new web while a lower roller on the compensation device moves away from the new paper roll to maintain the effective travel path of the depleting web constant so that the web's tension remains the same and the web does not elongate.

8 Claims, 4 Drawing Sheets

DEVICE FOR CONNECTING PAPER WEBS

FIELD OF THE INVENTION

The present invention is directed generally to a device for connecting paper webs. More particularly, the present invention is directed to a device for connecting two paper webs in an automatic roll changer. Most specifically, the present invention is directed to a device for connecting two paper webs in an automatic roll changer of a web-fed rotary printing press with means for compensating for web length changes during a paper web splice. The device utilizes a pivotable support frame which carries a compensation device at one end. The compensation device utilizes two spaced double armed levers that have upper and lower web engaging rollers supported between the upper and lower ends of the levers. As the upper of these rollers exerts a force on the web during a web change, the lower roller exerts a reduced force on the web thereby lessening possible web length changes.

DESCRIPTION OF THE PRIOR ART

It is generally well known in the art to utilize paper rolls on roll supports in web-fed rotary presses. Typically two paper web rolls are supported by a roll support with one web being used while the second roll is in a standby or waiting position. As the first roll becomes exhausted, the supply of paper to the press is changed to the standby roll during a so-called flying web change. Various different assemblies are known in the art for use in the accomplishment of paper web roll changes.

A device for gluing or otherwise securing a fresh web to an exhausting or diminishing paper web is shown in German Letters Patent No. 878 945. In this assembly, the fresh paper web is provided with a suitably prepared adhesive leading tip on the outside surface of the leading end of the paper web on the roll. The paper web roll being used, is pressed against this prepared surface of the fresh paper web roll by use of brush elements that are forced against the exhausting paper web. During the accomplishment of this web splicing, it is desirable to avoid stretching of the paper web that is being exhausted. Such a stretching of the web could result in a tearing of the web and a resultant stoppage of press operation. In this prior German Letters Patent No. 878 945 stretching of the paper web and possible paper web tearing during the pressing operation of joining the webs together is prevented by providing two movable rods or rollers. While one of these rollers presses the exhausting paper web against the surface of the new paper web roll to which it is to be spliced, the second roller moves in the opposite direction.

A limitation of this prior art device is that the two rollers have a relatively large inertia because of the mass of these rollers. This inertia cannot be overcome, during a web splice or gluing operation, in a fraction of a second. However the speed of web travel in present day high-output web-fed rotary printing presses provides only a very limited time in which the web gluing or splicing procedure must be accomplished. The relatively high inertia of this prior device is not compatible with the accomplishment of fast web changes.

In a different prior art paper web gluing or splicing device for rotary printing presses, as shown in German Democratic Republic Patent No. DD-WP 86 409, the paper web which is running out or being exhausted is brought into contact with the fresh roll by means of a guide roller. At the same time, a pressing brush that is used to press the exhausting paper web against the prepared adhesive or splice portions of the new or standby web roll, and a second roller for use in compensating for paper web length changes in the exhausting paper web are moved out. The adjusting means of the two rollers and the brush are connected to each other in such a way that the guide roller, the pressing brush, and the compensating roller are all adjusted by means of a screw drive. This screw drive is operated by a motor which can be rapidly turned on and which acts on a lever fastened on the brush shaft and to which an adjusting rod for pivoting the guide roller and the compensating roller is hinged.

A limitation of this prior art device is that it is necessary to provide a large outlay for driving and transmitting elements to accomplish the connection of the two paper webs to each other. These drive elements have a large amount of inertia due to their mass. In present high-output web-fed rotary printing presses which have paper web running speeds in the area of 15 meters/-second and above, the accomplishment of a paper web splice must take place in very short periods of time. The inertia of this prior art device renders it too slow for use in present high speed devices.

It will thus be apparent that a need exists for a device for connecting paper webs which overcomes the limitations of the prior art devices. The assembly in accordance with the present invention provides such a device and is a significant advance over the prior art.

SUMMARY OF THE INVENTION

It is an object of the present invention to provide a device for connecting paper webs.

Another object of the present invention is to provide a device for connecting two paper webs in an automatic roll changer.

A further object of the present invention is to provide a device for connecting two paper webs in an automatic roll changer of a web-fed rotary printing press.

Yet another object of the present invention is to provide a device for connecting paper webs with no increase in paper web tension.

Still a further object of the present invention is to provide a device for connecting paper webs which has a low inertia.

Even another object of the present invention is to provide a device for connecting paper webs which compensates for paper web length changes.

As will be discussed in detail in the description of the preferred embodiment which is set forth subsequently, the device for connecting paper webs in accordance with the present invention utilizes a pivotable support frame that is secured to the frame of the press. A compensation device is secured to a free end of the pivotable support frame. This compensation device utilizes two spaced double arm levers that are secured to the support frame by a rotatable shaft. These double arm levers carry guide rollers at the upper and lower ends of each of the two arms of the two armed levers. The guide rollers engage the web that is being withdrawn from the paper web roll. During a flying web change, as one guide roller is exerting increased pressure on the webs, the second guide roller is exerting reduced pressure. This is accomplished by movement of the two double arm levers in concert about their pivot or rotary shaft through the use of suitable actuating cylinders. A cutter bar is also provided to accomplish web severance after the splice has been accomplished.

The device for connecting paper webs in accordance with the present invention is low in mass and thus does not have a great deal of inertia. This allows the device to accomplish a flying paper web splice on the very fast moving webs of the present printing presses.

The paper webs are connected to each other by increasing the web pressure exerted by one of the guide rollers on the two double armed levers while at the same time reducing the web pressure exerted by the second roller. This connection of the paper webs, without any change in paper tension because of the compensation for change in the paper web length which inevitably takes place, is accomplished without the need for a great technical outlay for gears and the like, as was the case in the prior art devices. The device for connecting paper webs in accordance with the present invention prevents ripping, stretching and tearing of the paper web, even at high press speeds. The device overcomes the limitations of the prior art devices and is a substantial advance in the art.

BRIEF DESCRIPTION OF THE DRAWINGS

While the novel features of the device for connecting paper webs in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
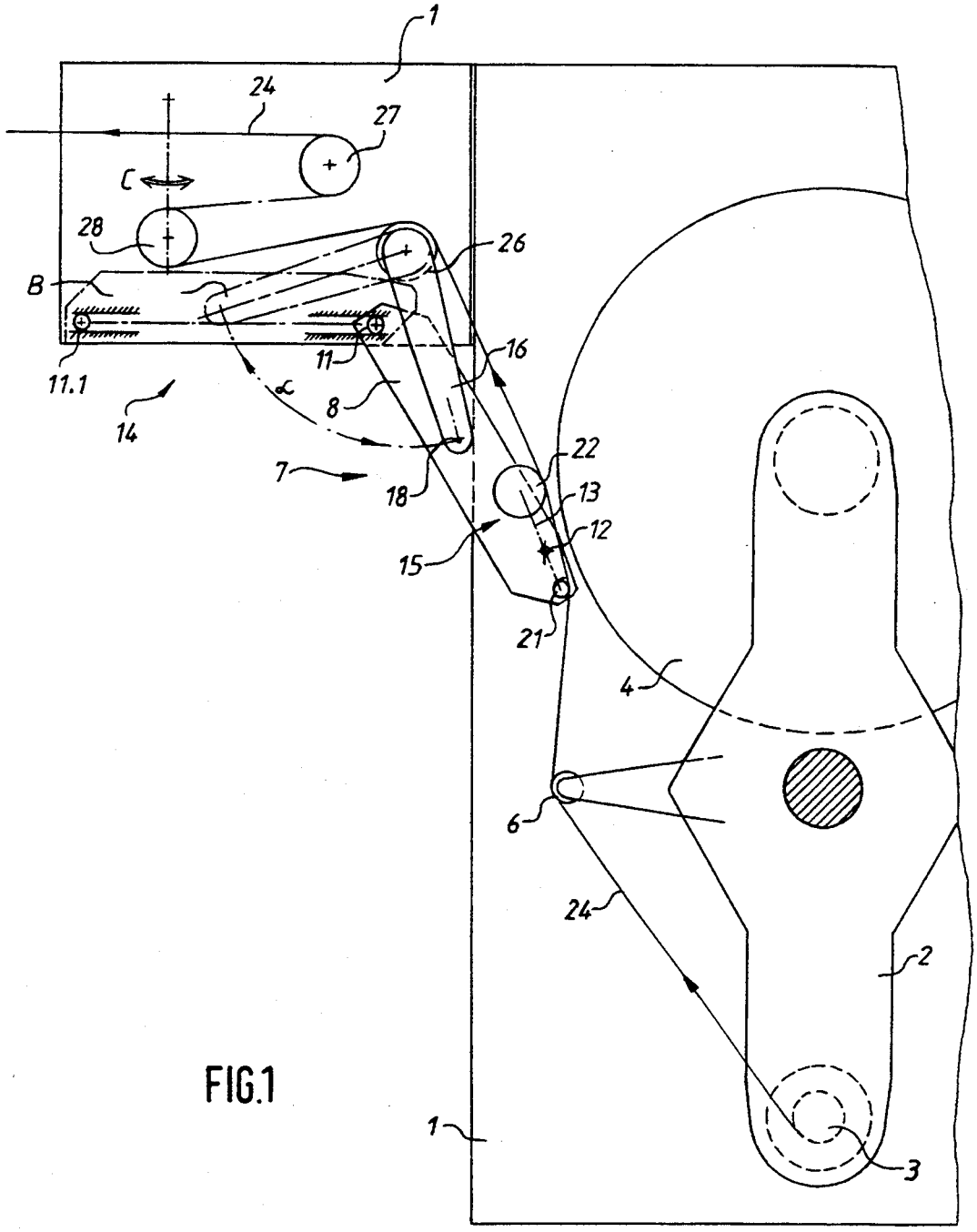
FIG. 1 is a schematic side elevation view of the device for connecting paper webs in accordance with the present invention.

Referring initially to FIG. 1, there is shown a preferred embodiment of a device for connecting paper webs in accordance with the present invention. A press frame of a web-fed rotary printing press is depicted generally at 1. It will be understood that the specific type of printing press with which the present invention is utilized, is not significant so long as the press is web-fed. A roll support, generally at 2, is located in the press frame 1. This roll support carries an active paper web roll 3, which is depicted as being nearly exhausted or running out, and a standby or fresh paper web roll 4 which will be spliced or connected to the paper web 24 being removed from the exhausting roll 3. A suitable adhesive tip, array of splice tape or the like is provided on the exterior surface of the leading end of the paper web on the fresh paper roll 4. The specific structure of this adhesive tip or the like is not important to the present invention and it is not specifically shown. The roll support 2 also supports a paper guide roller 6 which is supported at one end of an arm between the two paper web rolls. This paper guide roller 6 is rotatably supported at the free end of the arm or arms.

Figure 3:
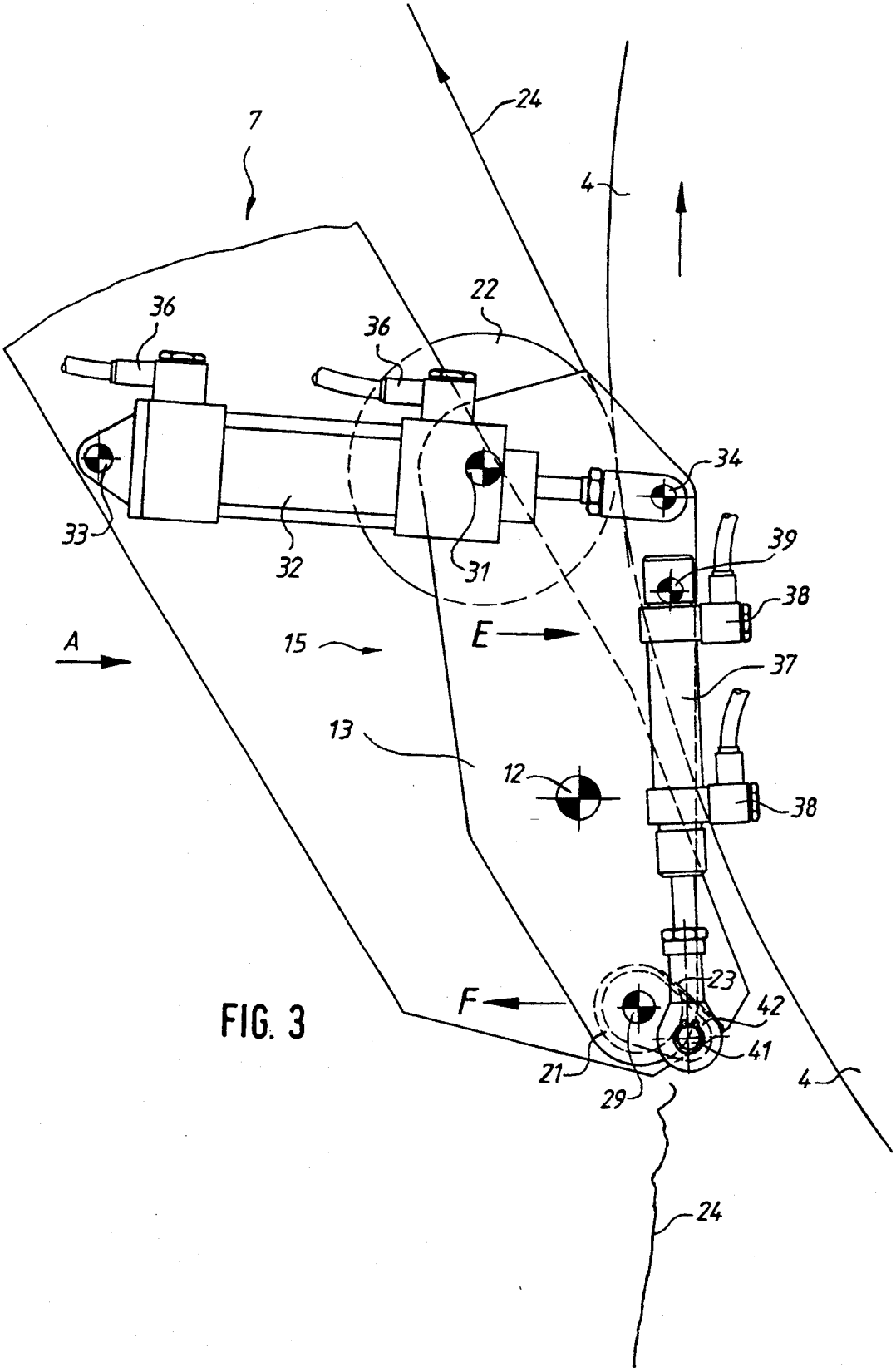
FIG. 3 is a view similar to FIG. 2 and showing the compensation device in the operating position.
Figure 4:
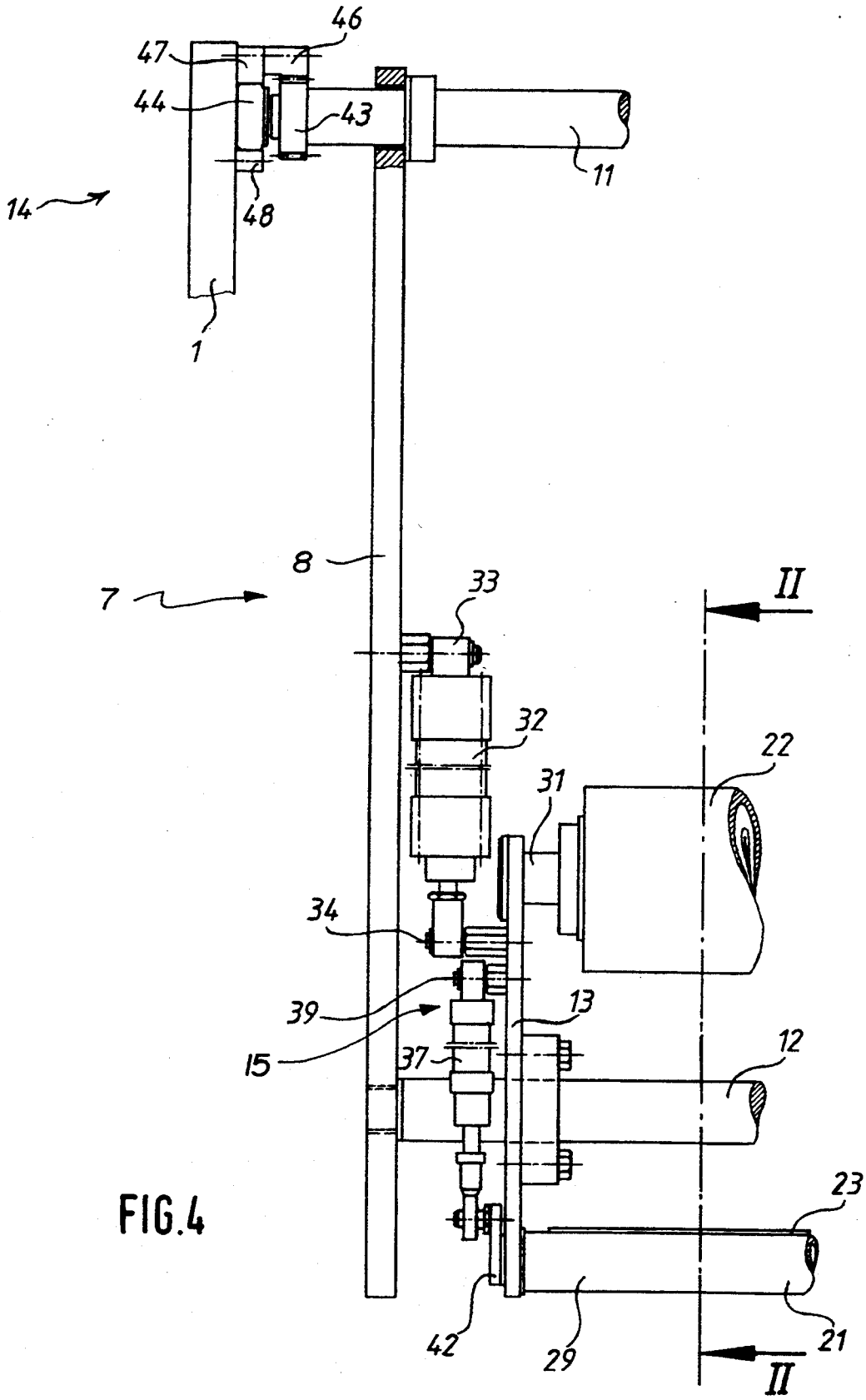
FIG. 4 is a rear elevation view of a portion of the present invention taken in the direction indicated by arrow A in FIG. 2.

Referring again primarily to FIG. 1 and also as may be seen in FIG. 4, a pivotable support frame, generally at 7, is supported by the press frame 1. This pivotable support frame 7 utilizes a pair of parallel, spaced, lateral support elements 8 and 9 that extend generally parallel to the press frame 1. Only lateral support element 8 is visible in FIGS. 3 and 4 but it will be understood that lateral support element 9 is the same and is located at the other side of the press frame 1. The support frame 7 is movable between a rest position B, shown in dot-dash lines in FIG. 1 and an active position which is shown in FIG. 1 in full lines. A drive shaft 11 is secured between the two lateral support elements 8 and 9 and, as will be discussed in detail subsequently, is shiftable in a parallel guide, generally at 14 which is fixed on the press frame 1. First or inner ends of the two lateral support elements 8 and 9 are secured to the shaft 11. A pair of guide levers 16 and 17 are pivotably connected at first ends to the lateral support elements 8 and 9 of the support frame 7, as shown in FIG. 1. These guide levers 16 and 17 are connected at their first ends to lateral support elements 8 and 9 intermediate the ends of the support elements. These guide levers 16 and 17 are also both secured at second ends to the press frame 1. As the drive shaft 11 of the support frame 7 is actuated and moves from its rest position shown at 11.1 to its active position show at 11 in FIG. 1, the two guide levers 16 and 17 pivot so that the support frame assembly 7 moves through a pivot angle $\alpha$ of between about 90° to 140° and preferably through a pivot angle of about 120°.

Figure 2:
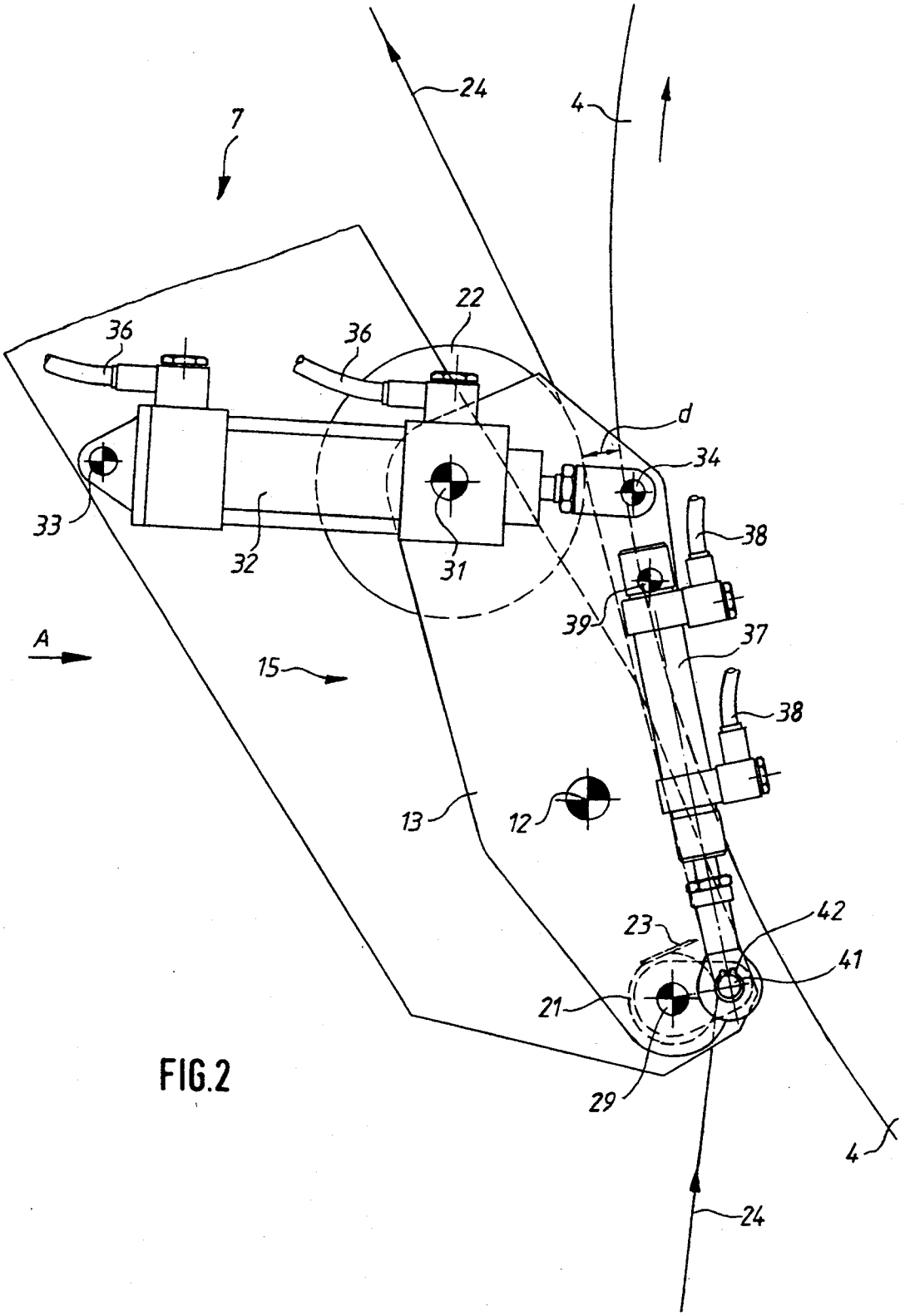
FIG. 2 is an enlarged side elevation view of the compensation device portion of the present invention, taken along line II—II of FIG. 4 and showing the device in the preparation position.

Turning now primarily to FIGS. 2 and 3, and as seen generally in FIG. 1 a rotary shaft 12 is supported for rotation between second, free ends of the two lateral elements 8 and 9. This rotatable shaft 12 is supported by suitable bearings which are not specifically shown. A two armed lever 13 of a compensation device, generally at 15, is supported intermediate the ends of its two arms by each end of rotatable shaft 12. One such two arm lever 13 is carried by rotatable shaft 12 inboard of its associated element 8 or 9. Only one such two arm lever 13 is shown in FIGS. 1–4 but it will be understood that the compensation device 15 utilizes two such two armed levers 13. Rotatable shaft 12 forms a pivot shaft to which the two armed levers 13 are attached. As the support frame, generally at 7, moves from the rest position B, as seen in dashed lines in FIG. 1 to its active position, as seen in solid lines in FIG. 1, the compensation device 15 will move into a position generally adjacent the fresh roll 4 on the roll support 2, as also shown in FIG. 1. The compensation device, generally at 15 is now positionable either in a preparatory position, as shown in FIG. 2 or in an active or working position, as shown in FIG. 3. Once a web splice has been accomplished, the support frame 7 can be moved back to its rest position depicted at B in FIG. 1 to move the compensation device, generally at 15 out of the area of the paper web rolls.

Referring again primarily to FIGS. 2, 3 and 4, a first, lower guide roller 21 is supported for rotation between lower ends of the two double armed levers 13. This lower guide roller 21 is on the ends of the double armed levers 13 closer to the roll support 2. A second, upper guide roller 22 is supported between upper ends of the two double arm levers 13 at a location away from the roll support 2. The upper guide roller 22 is utilized as the adhesive or pressure roller during a web splice. The lower guide roller 21 supports the paper web 24 and is provided with a cutter bar 23 for severing the depleted paper web after the splice has been accomplished.

Two paper web guide rollers 26 and 27 are supported between the side frames 1 of the press after, in the direction of web travel, the compensation device 15. The paper web guide roller 26 is attached to the frame 1 at the point of frame attachment of the guide levers 16 and 17. A compensating roller 28 is placed between the two paper guide rollers 26 and 27. This compensating roller 28 can be moved in the frame 1 in the direction indicated by arrow C in FIG. 1 to compensate for changes in the length of the paper web travel path. As may be seen in FIG. 1, in the preparation of a paper web 24, the web runs from the depleting roll 3 over the fixed paper guide roll 6, over the lower and upper guide rollers 21 and 22 of the compensation device 15 of the present invention and around the guide rollers 26 and 27 and the compensation roller 28 when the pivotable support frame 7 is in its working position depicted in solid lines in FIG. 1. When the device for connecting paper webs in accordance with the present invention; i.1. support frame 7 and compensation device 15 are in the rest position B of the support frame 8, the paper web 24 is in contact with the fixed guide roller 6, the fixed guide rollers 26 and 27, and the compensating roller 28.

As may be seen most clearly in FIGS. 2 and 3, and as is also shown in FIG. 4, the compensation device 15 is positionable by movement of the pivotable support frame 7 into a position adjacent the new paper web roll 4. A standby or preparation position of the compensation device 15 is shown in FIG. 2 while a working position is shown in FIG. 3. The lower guide roller 21 is rotatably supported between the two spaced double arm levers 13 by a lower shaft 29 while the upper guide roller 22 is rotatably supported between the two double arm levers 13 by an upper shaft 31. A pair of working cylinders 32, only one of which is shown in the drawings, have first ends secured to the lateral elements 8 and 9 of the pivotable support frame 7 at pivot points 33 and have second ends secured to the upper ends of the double arm levers 13 at pivot points 34 which are generally adjacent the ends of upper shaft 31 of upper guide rollers 22. These work cylinders 32, which are preferably double acting pneumatic cylinders, are provided with operating fluid, such as compressed air under pressure through suitable connecting sockets 36. These pneumatic cylinders 32 are supplied with compressed air from a central compressed air supply installation (not shown) by way of suitable lines and control devices which are also not shown. For ease of understanding, the work cylinder 32 in FIG. 4 is depicted rotated generally 90° from its actual operating position. By actuation of the work cylinders 32, the distance "d" shown in FIG. 2 between the surface of the upper guide roller or adhesive roller 22 and the surface of the fresh paper web roll 4 can be changed. In the work position shown in FIG. 3 this distance "d" decreases to zero as the upper guide roller 22 or pressure applicator roller is used to press the depleting web 24 against the surface of fresh roll 4 to accomplish the flying web splice.

A first end of a pneumatic work cylinder 37 is attached to the lower portion of each of the two double arm levers 13 at hinge point 39. This hinge point 39 is generally adjacent hinge point 34 discussed above. A second end of each lower work cylinder 37 is connected at hinge point 41 to a first end of a coupler arm 42 that has a second end which is rotatable about the lower shaft 29 of the lower guide roller 21 on the two double arm lever 13. The cutter bar 23, used to sever the depleted web 24 after a splice has been made, is attached to the second ends of the couplers 42. This lower work cylinder 37 is also preferably a double acting pneumatic cylinder and is thus similar to the upper work cylinder 32. Suitable connecting sockets or connections 38 are used to supply compressed air to the two chambers of the lower working cylinder 37 in a controlled manner from a central compressed air supply source through suitable lines and control assemblies which are not specifically shown.

As previously mentioned, the drive shaft 11 is usable to move the pivotable support frame, generally at 7 between its rest position shown in dot-dash lines at B in FIG. 1 and its extended or active position, as shown in solid lines in FIG. 1. As may be seen most clearly in FIG. 4, the drive shaft 11 is provided on each of its ends with a toothed gear wheel 43. The shaft 11 is further provided with a suitable gear motor (not specifically shown) which is used to rotate shaft 11. Each of the toothed wheels 43 is in gear mesh engagement with a toothed rack 46 which is carried by the press frame 1. A guide roller 44 is also provided at each end of shaft 11 and these guide rollers 44 are positioned outboard from, and adjacent the toothed gear wheels 43. Each guide roller 44 for the pivotable support frame 7 is supported between upper and lower guide rails 47 and 48 which are secured to the press frame 1. Upon actuation of the drive motor for drive shaft 11, the cooperation of the toothed wheels 43 with their associated tooth racks 46 will cause the drive shaft 11 and hence the lateral support elements 8 and 9, which make up the pivotable support frame 7 to move between the two positions shown in FIG. 1. The pivotable movement of the guide levers 16 and 17 assist in constraining the movement of the pivotable support frame 7 between its rest and work positions.

The operation of the device for connecting paper webs in accordance with the present invention will now be discussed in detail. Assuming that the pivotable support frame 7 is in its rest position B, as shown in FIG. 1, the compensation device 15 carried at the free ends of lateral support elements 8 and 9 is also in a rest or retracted position. Actuation of the drive shaft 11 will now be effected, in advance of an upcoming paper web splice, to move the pivotable support frame 7 and the compensation device 15 to its preparation position which is shown in FIG. 2. Upon receipt of a control signal from the press central, or upon actuation of a suitable control by a press operator, the upper working cylinders 32 are extended and shift the upper portions of the two double arm levers 13, together with the upper guide roller or pressure roller 22 toward the surface of the fresh paper roll 4. The depleting paper web 24 from the exhausting paper web roll 3 is forced by the pressure or adhesive roller 22 against the exterior surface of the fresh paper web roll 4 which has been brought up to the appropriate rotational speed. The depleting web 24 is glued or otherwise adheres to the previously prepared adhesive tip of the fresh paper web or roll 4. At the same time that the pressure or adhesive roller 22 is being moved by the upper working cylinders 32 toward the fresh paper web roll 4, the lower guide roller 21 is being moved away from the fresh web roll 4. This is due to the rotation of the two double arm levers 13 about the central rotatable shaft 12. Thus the increase in tension of the paper web roll 24 due to the lengthening of its travel path caused by the advance of the upper roller 22 is compensated for by a corresponding decrease in its length of travel path by the retraction of the lower guide roller 21. It will be understood that the direction of advance of the upper pressure roller 22 is indicated by arrow E in FIG. 3 and that the direction of retraction of the lower guide roller 21 is indicated by arrow F, also in FIG. 3. Concurrently with the accomplishment of the flying splice, the lower coupler arms 42 and their associated cutter bar 23 give rotated by actuation of the lower work or cut-off cylinders 37. This severs the depleted paper web 24 from the depleted paper web roll 3 so that the paper web feed is now from the fresh paper web roll 4. As soon as the splice has been accomplished, the upper working cylinder 32 is retracted to move the compensation device 15 back to its standby or preparation position, as shown in FIG. 2. The drive shaft 11 for the pivotable support frame 7 is then actuated to return the support frame back to the rest position B shown in FIG. 1. The roll support 2 can now be manipulated to remove the depleted paper roll 3 and to put a new fresh paper web roll in its place. Once this has been done, the roll support 2 will be rotated through generally 180° so that the now exhausting paper web roll 4 will be placed beneath the new fresh paper web roll.

While a preferred embodiment of a device for connecting paper webs in accordance with the present invention has been set forth fully and completely hereinabove, it will be apparent to one of skill in the art that a number of changes in, for example, the roll support, the sizes of the paper web rolls, the bearings and the like could be made without departing from the true spirit and scope of the present invention which is accordingly to be limited only by the following claims.

I claim:

1. A device for connecting paper webs during a paper web splice in a web-fed rotary printing press, said paper web connecting device comprising:

a pivotable support frame having first and second ends, said first end being shiftably secured to a press frame, said pivotable support frame being supported by a rotatable drive shaft in a guide frame at said first end and including guide levers, said guide levers having first ends secured to said pivotable support frame and having second ends pivotably secured to a press frame;

a paper web tension compensation device pivotably supported by said second end of said pivotable support frame;

an upper pressure roller rotatably supported at an upper portion of said compensation device;

a lower guide roller rotatably supported at a lower portion of said compensation device;

means to pivot said pivotable support frame between a rest position and a work position in which said compensation device is adjacent a depleting paper web to be spliced to a fresh paper web; and means to advance said upper pressure roller toward a fresh paper web and to retract said lower guide roller away from a depleting paper web a compensating distance to effect a paper web splice while maintaining a uniform paper web tension.

2. The paper web connecting device of claim 1 further including a paper web cutter bar supported by said lower guide roller.

3. The paper web connecting device of claim 2 further including a working cylinder, said working cylinder being usable to shift said cutter bar into and out of engagement with a paper web.

4. The paper web connecting device of claim 1 wherein said support frame is pivotable through a pivot angle in the range of 90° to 140°.

5. A device for connecting paper webs during a paper web splice in a web-fed rotary printing press, said paper web connecting device comprising:

a pivotable support frame having first and second ends, said first end being shiftably secured to a press frame;

a paper web tension compensation device pivotably supported by said second end of said pivotable support frame;

an upper pressure roller rotatably supported at an upper portion of said compensation device;

a lower guide roller rotatably supported at a lower portion of said compensation device;

means to pivot said pivotable support frame between a rest position and a work position in which said compensation device is adjacent a depleting paper web to be spliced to a fresh paper web; and a double acting cylinder, said double acting cylinder being actuatable to pivot said compensation device on said second end of said pivotable support frame to advance said upper pressure roller toward a fresh paper web and to retract said lower guide roller away from a depleting paper web a compensating distance to effect a paper web splice while maintaining a uniform paper web tension.

6. The paper web connecting device of claim 5 further including a paper web cutter bar supported by said lower guide roller.

7. The paper web connecting device of claim 6 further including a working cylinder, said working cylinder being usable to shift said cutter bar into and out of engagement with a paper web.

8. The paper web connecting device of claim 5 wherein said support frame is pivotable through a pivot angle in the range of 90° to 140°.

* * * * *